US007484591B2

(12) United States Patent
Kess

(10) Patent No.: US 7,484,591 B2
(45) Date of Patent: Feb. 3, 2009

(54) MUFFLER OUTLET PART FOR A MOTORCYCLE MUFFLER

(76) Inventor: Roland Kess, Muhlenstrasse 9, Theres-Horhausen (DE) D-97531

( * ) Notice: Subject to any disclaimer, the term of this patent is extended or adjusted under 35 U.S.C. 154(b) by 190 days.

(21) Appl. No.: 11/488,025

(22) Filed: Jul. 18, 2006

(65) Prior Publication Data

US 2007/0012510 A1 Jan. 18, 2007

(30) Foreign Application Priority Data

Jul. 18, 2005 (DE) ..... 20 2005 011 448 U

(51) Int. Cl.
*F01N 1/00* (2006.01)
*F01N 7/08* (2006.01)
*F01N 7/18* (2006.01)
*F01N 1/16* (2006.01)

(52) U.S. Cl. ..... 181/254; 181/227; 181/241; 181/277

(58) Field of Classification Search ..... 181/254, 181/227, 241, 277
See application file for complete search history.

(56) References Cited

U.S. PATENT DOCUMENTS 207,384 A * 8/1878 Beck ..... 181/254
867,973 A * 10/1907 Hoover ..... 181/277
895,697 A * 8/1908 Snow ..... 181/254
996,800 A * 7/1911 Schmitt ..... 181/254
1,019,571 A * 3/1912 West ..... 116/138
1,276,935 A * 8/1918 Leary ..... 181/277
1,345,418 A * 7/1920 Tvedt ..... 181/261
1,473,235 A * 11/1923 Dorado ..... 181/277
1,709,426 A * 4/1929 Beery ..... 191/254
1,781,001 A * 11/1930 Eisele ..... 181/254
1,795,947 A * 3/1931 Haas ..... 181/254
1,818,469 A * 8/1931 Floyd, Jr. ..... 181/254
1,829,737 A * 11/1931 Compo ..... 181/254
1,840,082 A * 1/1932 Breer ..... 181/254
1,860,146 A * 5/1932 Gray ..... 181/254
1,860,892 A * 5/1932 Gray ..... 181/254
2,066,467 A * 1/1937 Gray ..... 181/247
2,096,000 A * 10/1937 Miles ..... 181/253

(Continued)

FOREIGN PATENT DOCUMENTS

DE 101 04 293 A1 3/2002

(Continued)

*Primary Examiner*—Walter Benson
*Assistant Examiner*—Christina Russell
(74) *Attorney, Agent, or Firm*—Browdy and Neimark, P.L.L.C.

(57) ABSTRACT

A muffler outlet part for a muffler to be used in exhaust systems of motorcycles has at least one main body disposed transversely to an outflow direction of exhaust gas and having a center axis, the main body having a centrical first outlet opening disposed concentrically relative to the center axis for the outflow of exhaust gas from an outlet chamber of the muffler, and at least one second outlet opening disposed eccentrically relative to the center axis for the outflow of exhaust gas from an expansion chamber of the muffler, said expansion chamber enclosing the outlet chamber. It further has at least one closing member that is swivel-mounted about the center axis for an at least partial closing of the at least one second outlet opening, and at least one adjustment element for swiveling of the closing member via an adjustment means, which cooperates in a torque-transmitting manner with the at least one adjustment element.

30 Claims, 10 Drawing Sheets

U.S. PATENT DOCUMENTS

| | | | | | |
|---|---|---|---|---|---|
| 2,479,165 | A | * | 8/1949 | Jackson | 181/277 |
| 2,679,230 | A | * | 5/1954 | Ward | 116/138 |
| 3,000,465 | A | * | 9/1961 | Bruno | 181/277 |
| 3,145,800 | A | * | 8/1964 | Marx | 181/241 |
| 3,154,174 | A | * | 10/1964 | Haining | 181/254 |
| 3,340,954 | A | * | 9/1967 | Benjamen | 181/256 |
| 3,390,738 | A | * | 7/1968 | Kirsch et al. | 181/241 |
| 3,545,566 | A | * | 12/1970 | Abrahamsson | 181/241 |
| 3,642,095 | A | * | 2/1972 | Fujii | 181/271 |
| 3,938,905 | A | * | 2/1976 | Wadensten | 415/119 |
| 4,031,979 | A | * | 6/1977 | Raleigh | 181/240 |
| 4,643,272 | A | * | 2/1987 | Gaffrig | 181/260 |
| 4,715,472 | A | * | 12/1987 | McKee | 181/241 |
| 4,731,992 | A | * | 3/1988 | Krumscheid | 60/281 |
| 5,146,434 | A | * | 9/1992 | Bromley | 367/140 |
| 6,006,859 | A | * | 12/1999 | Hussaini | 181/227 |
| 6,338,246 | B2 | * | 1/2002 | Eguchi et al. | 60/324 |
| 6,367,580 | B1 | * | 4/2002 | Chang | 181/241 |
| 6,494,290 | B1 | * | 12/2002 | Jessberger | 181/250 |
| 6,810,992 | B1 | * | 11/2004 | Lombardo | 181/227 |
| 6,915,876 | B2 | * | 7/2005 | Ciray | 181/219 |
| 2005/0067218 | A1 | * | 3/2005 | Bristow et al. | 181/237 |

FOREIGN PATENT DOCUMENTS

| | | | |
|---|---|---|---|
| DE | 101 11 369 | A1 | 9/2002 |
| EP | 1 099 829 | A2 | 5/2001 |
| EP | 1 445 437 | A1 | 8/2004 |
| FR | 1.158.183 | | 6/1958 |
| JP | 60-178917 | | 9/1985 |
| WO | WO 2005/026508 | A1 | 3/2005 |

* cited by examiner

MUFFLER OUTLET PART FOR A MOTORCYCLE MUFFLER

BACKGROUND OF THE INVENTION

1. Field of the Invention

The invention is concerned with a muffler outlet part for a muffler to be used in exhaust systems of motorcycles. The invention is additionally concerned with a muffler to be used in exhaust systems of motorcycles.

2. Background Art

Exhaust systems of motorcycles must comply with legal noise emission limits. Within the framework of the legal noise emission limits, however, motorcyclists desire a maximum sound level of the exhaust system while riding. Legal noise emission limits are not set uniformly throughout the world, so that a complex adaptation to the given locally prevailing noise emission limits is required in the case of exhaust systems intended for exportation.

From EP 1 099 829 A2, a muffler for exhaust systems of motorcycles is known that has a swivel-mounted adjustment plate for the closing and opening of outlet openings. The adjustment plate renders the sound level and exhaust back pressure of the exhaust system adjustable. Mufflers of this type have the shortcoming that adjusting the sound level is complex and complicated.

SUMMARY OF THE INVENTION

The invention is based on the object of creating a muffler outlet part and muffler for use in exhaust systems of motorcycles that permit a simple and convenient adjustment of the sound level of the exhaust system.

This object is met with a muffler outlet part for a muffler to be used in exhaust systems for motorcycles, having at least one main body disposed transversely to an outflow direction of exhaust gas and having a center axis, the main body having a centrical first outlet opening disposed concentrically relative to the center axis for the outflow of exhaust gas from an outlet chamber of the muffler and at least one second outlet opening disposed eccentrically relative to the center axis for the outflow of exhaust gas from an expansion chamber of the muffler, said expansion chamber enclosing the outlet chamber, and at least one closing member that is swivel-mounted about the center axis for an at least partial closing of the at least one second outlet opening, and at least one adjustment element for swiveling of the closing member via an adjustment means, which cooperates in a torque-transmitting manner with the at least one adjustment element. The gist of the invention lies in that, to provide for swiveling of the closing member, at least one adjustment element is provided. The at least one adjustment element is designed such that it can be actuated via an adjustment means, in such a way that said adjustment means cooperates in a torque-transmitting manner with the at least one adjustment element for swiveling of the closing member. The at least one adjustment element permits a simple and convenient swivel-type displacement of the closing member via the adjustment means and, therefore, adjustment of the sound level of the exhaust system, specifically in such a way that touching the potentially hot closing member is not required during the swiveling process.

Additional characteristics and advantages of the invention will become apparent from the description of example embodiments based on the drawing.

DESCRIPTION OF THE PREFERRED EMBODIMENTS

Figure 1:
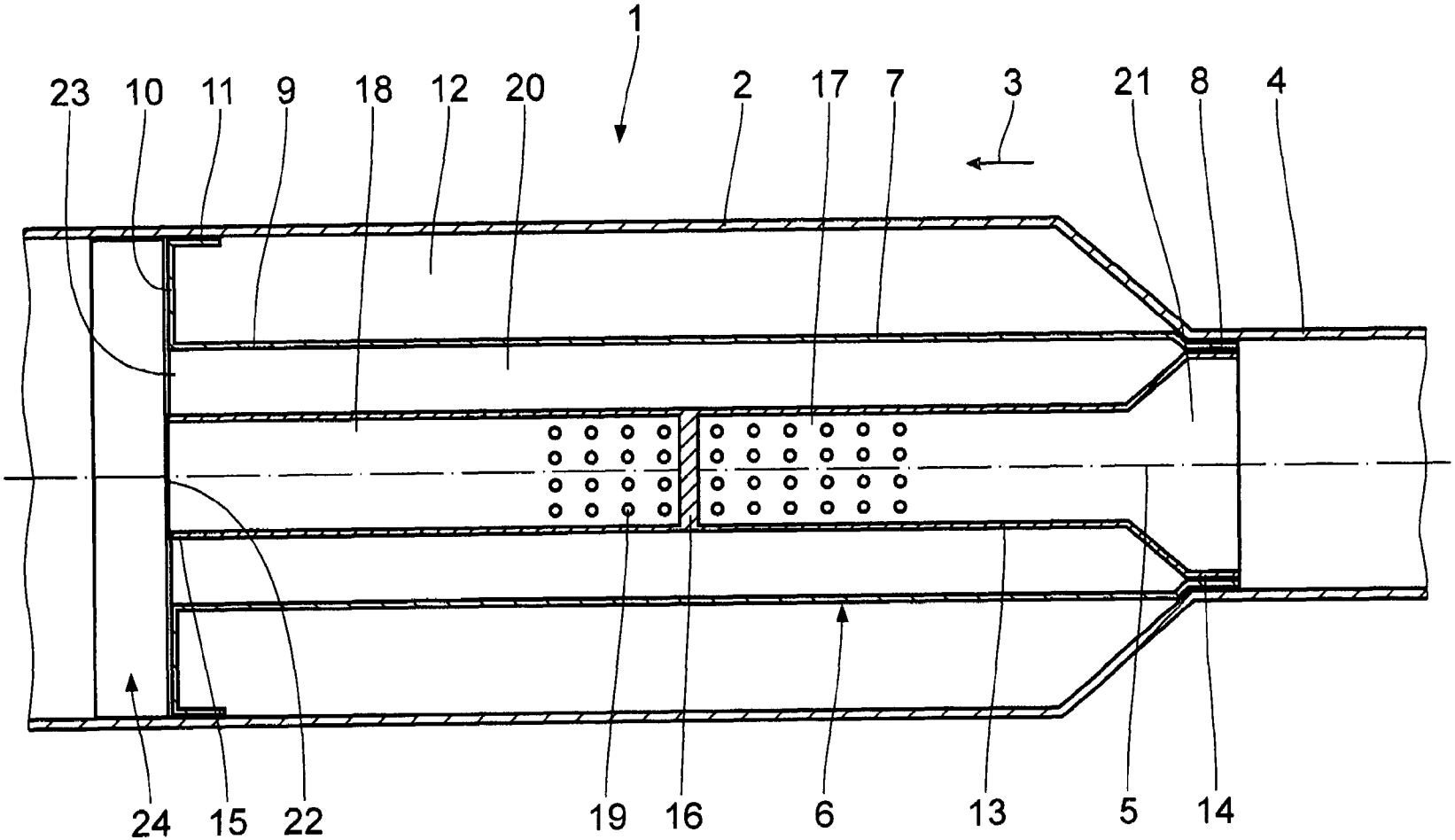
FIG. 1 shows a schematic illustration of a muffler to be used in exhaust systems of motorcycles.

In the text that follows, a first example embodiment of the invention will be described under reference to FIGS. 1 through 4. A muffler 1 for use in exhaust systems of motorcycles has a hollow-cylindrical muffler housing 2, which tapers in a direction opposite the outflow direction 3 of exhaust gas, and which is formed as one piece with a connecting pipe 4. Within the muffler housing 2, a muffler insert 6 is disposed concentrically relative to a center longitudinal axis 5 of the muffler 1.

The muffler insert 6 has an outer expansion pipe 7, which tapers at a first expansion pipe end 8 against the outflow direction 3, and which is connected frictionally engaged as well as gas-tight to the connecting pipe 4. Disposed at a second expansion pipe end 9, formed as one piece with the expansion pipe 7, is an end disc 10 whose ring-shaped outer disc end 11 is bent at an angle and rests against the muffler housing 2 to support and center the muffler insert 6. The muffler housing 2, the expansion pipe 7, and the end disc 10 delimit an annular absorption chamber 12, which is filled with an absorption material, which is not depicted.

Within the expansion pipe 7, the muffler insert 6 has an inner flow pipe 13, which widens against the outflow direction 3 in a funnel shape and which rests with a first flow-pipe end 14 frictionally engaged and gas-tight against the expansion pipe 7 in the region of the first expansion pipe end 8. At a second flow pipe end 15, the flow pipe 13 is joined in one piece with the end disc 10.

Within the flow pipe 13, a disc-shaped baffle plate 16 is formed as one piece with the flow pipe 13, centered relative to the flow pipe 13 and transversely to the center longitudinal axis 5. The baffle plate 16 is gas-tight and divides the flow pipe 13 into an intake chamber 17 and an outlet chamber 18 situated downstream from the intake chamber 17 in the outflow direction 3. The intake chamber 17 and the outlet chamber 18 are connected by a plurality of flow pipe openings 19 in the region of the baffle plate 16 of the flow pipe 13 to an expansion chamber 20, which encloses the intake chamber 17 and the outlet chamber 18 in a ring shape, and which is substantially delimited by the expansion pipe 7, the end disc 10, and the flow pipe 13.

The intake chamber 17 is connected for the inflow of exhaust gas to an inlet opening 21, which is formed in the region of the first flow pipe end 14 and enclosed by the flow pipe 13. For the outflow of exhaust gas from the outlet chamber 18, the same is connected to a circular outlet-chamber opening 22 formed in the end disc 10 and disposed concentrically relative to the center longitudinal axis 5. Additionally, the expansion chamber 20 is connected to a plurality of expansion chamber openings 23 for the outflow of exhaust gas, which are formed in the end disc 10 in the region between the expansion pipe 7 and the flow pipe 13.

Disposed downstream from the muffler insert 6 in the outflow direction 3 is a muffler outlet part 24. The muffler outlet part 24 is disposed within the muffler housing 2 and fastened to it or to the end disc 10. Alternatively, the muffler outlet part 24 may also be designed as a slip-on part and placed onto the muffler 1 at its free end. The muffler outlet part 24 and its placement in the muffler 1 are outlined in FIG. 1.

The muffler outlet part 24 has a substantially disc-shaped main body 25 with a center axis 26, in such a way that, in the installed condition of the muffler outlet part 24, the main body 25 is disposed transversely to the outflow direction 3, and the center axis 26 coincides with the center longitudinal axis 5 of the muffler 1. For the outflow of exhaust gas from the outlet chamber 18, the main body 25 has a centrical first outlet opening 27 that is disposed concentrically relative to the center axis 26 and connected to the outlet chamber 18 by means of the outlet chamber opening 22. For the connection to the outlet chamber 18, a connecting ring 28 that rests against the end disc 10 is provided around the first outlet opening 27 and protrudes along the center axis 26. For the outflow of exhaust gas from the expansion chamber 20, the main body 25 additionally has a plurality of second outlet openings 29 disposed eccentrically relative to the center axis 26, which are connected to the expansion chamber 20 via the expansion chamber openings 23. The second outlet openings 29 are disposed diametrically relative to the center axis 26 and evenly spaced about the center axis 26.

For opening and closing the second outlet openings 29, an annular closing member 30 is provided that is disposed in an annular first main-body recess 31 disposed concentrically relative to the center axis 26. The first main-body recess 31 creates, in the main body 25, a circular main-body end stop 32 that serves to secure the closing member 30 radially relative to the center axis 26.

To provide for swiveling of the closing member 30 about the center axis 26, said closing member 30 has a centrical first closing-member opening 33 wherein, to support the closing member 30, a bearing ring 34 that is formed as one piece around the first outlet opening 27 of the main body 25, extends through the first closing-member opening 33. For opening and closing the second outlet openings 29, the closing member 30 has disposed in it a plurality of second closing-member openings 35 in such a way that, in the first swivel position shown in FIG. 3, they completely overlap with the second outlet openings 29. Between two adjacent closing-member openings 35 a closing-member bridge 36 is formed in each case, in such a way that the closing-member bridges 36 completely close the second outlet openings 29 in a second swivel position, or partially close them in the swivel position shown in FIG. 2. To provide for a simpler installation of the muffler outlet part 24, the main body 25 has an annular second main-body recess 37, which is immediately adjacent to the expansion chamber openings 23.

The closing member 30 has a first side wall 38 facing the main body 25, a second side wall 39 facing away from the main body 25, and a circumferential wall 40 facing the main-body end stop 32. The closing member 30 rests with the first side wall 38 against the main body 25. To provide for swiveling of the closing member 30, a first adjustment element 41 is disposed on the circumferential wall 40 in such a way that the first adjustment element 41 is implemented as a toothing having a plurality of successive teeth 42. The first adjustment element 41 is disposed in the region of a main-body extension 43, in such a way that the main-body extension 43 serves to accommodate a second adjustment element 44 and a third adjustment element 45. The adjustment elements 44, 45 are designed as toothed wheels, in such a way that the second adjustment element 44 directly cooperates with the first adjustment element 41, and the third adjustment element 45 directly cooperates with the second adjustment element 44. For accommodating and supporting the second adjustment element 44, the main body 25 and the main-body extension 43 formed as one piece with the former have a step-shaped first bearing recess 46, in which the second adjustment element 44 is accommodated in a manner so that it can rotate. In a corresponding manner, the main-body extension 43 has provided in it a step-shaped second bearing recess 47, in which the third adjustment element 45 is accommodated in a manner so that it can rotate. To provide for the cooperation of the adjustment elements 41, 44, 45, the bearing recesses 46, 47 and the first main-body recess 31 are connected to each other. The number of teeth 42 of the first adjustment element 41 is such that the closing member 30 can swivel at least from the first swivel position into the second swivel position.

For the actuation of the closing member 30, the third adjustment element 45 has a shaft 48 joined to it in one piece, in such a way that the shaft 48 extends through a shaft opening 49 of the main-body extension 43. The shaft 48 serves for the torque-transmitting cooperation of an adjustment means 50, which is shown only schematically, with the adjustment elements 41, 44, 45 for swiveling of the closing member 30. Alternatively, the shaft 48 may also be joined in one piece with the second adjustment means 44, and the third adjustment element 45 may be eliminated altogether. The adjustment means 50 may be implemented essentially as desired, for example mechanically, pneumatically, or electrically. In particular, a servomotor or an electromagnet are provided as the adjustment means 50.

To delimit the swivel movement, the closing member 30 has, in the region of the circumferential wall 40 and adjacent to the first adjustment element 41, a groove 51 that extends concentrically relative to the center axis 26 and that cooperates with a delimiting element 52 designed in the form of a sleeve. The groove 51 has a groove bottom 53 and groove side walls 54, in such a way that the delimiting element 52 rests against the groove bottom 53 and comes in contact against the groove side walls 54 as a limit stop. The delimiting element 52 is partially accommodated, in the region of the main-body end stop 32, in a main-body end stop recess 55.

Relative to the center axis 26 opposite the first main-body end stop recess 55, the main body 25 has, in the region of the main-body end stop 32, a second main-body end stop recess 56. Disposed in the second main-body end stop recess 56 is a spring element 57 that is designed as a helical spring, and disposed thereon is an elastic locking element 58 in the form of a ball. To lock the locking member 30 relative to the main body 25, the locking element 58 cooperates with locking recesses 59. The locking recesses 59 are implemented funnel-shaped and disposed spaced apart along the circumferential wall 40 of the locking member 30. During the locking process, the locking element 58 snaps into one of the locking recesses 59.

To secure the locking member 30 and adjustment elements 44, 45 along the outflow direction 3, a closing cap 60 is provided, which is substantially ring-shaped and designed with an extension corresponding to the main-body extension 43. The closing cap 60 is not shown in FIGS. 2 and 3. The closing cap 60 partially rests against the second side wall 39 of the closing member 30 and against the adjustment elements 44, 45. To provide for fastening of the closing cap 60, the main body 25 has provided in it fastening bores 61 with interior threads 62, in which screws can be fastened that are guided through corresponding bores of the closing cap 60.

To provide for fastening of the muffler outlet part 24 to the end disc 10, additional bores 63, through which the fastening elements are guidable, are provided in the main body 25 and in the closing cap 60.

In the text that follows, the mode of operation of the muffler 1 will be described. The exhaust gas first flows in the outflow direction 3 through the inlet opening 21 into the intake chamber 17. On the baffle plate 16 the exhaust gas is partially reflected, thus already causing the sound to be partially absorbed. The exhaust gas that is not reflected on the baffle plate 16 enters through the flow pipe openings 19 into the expansion chamber 20, where an expansion of the exhaust gas and associated sound absorption are attained. The sound is additionally absorbed by the absorption material provided in the absorption chamber 12.

Figure 2:
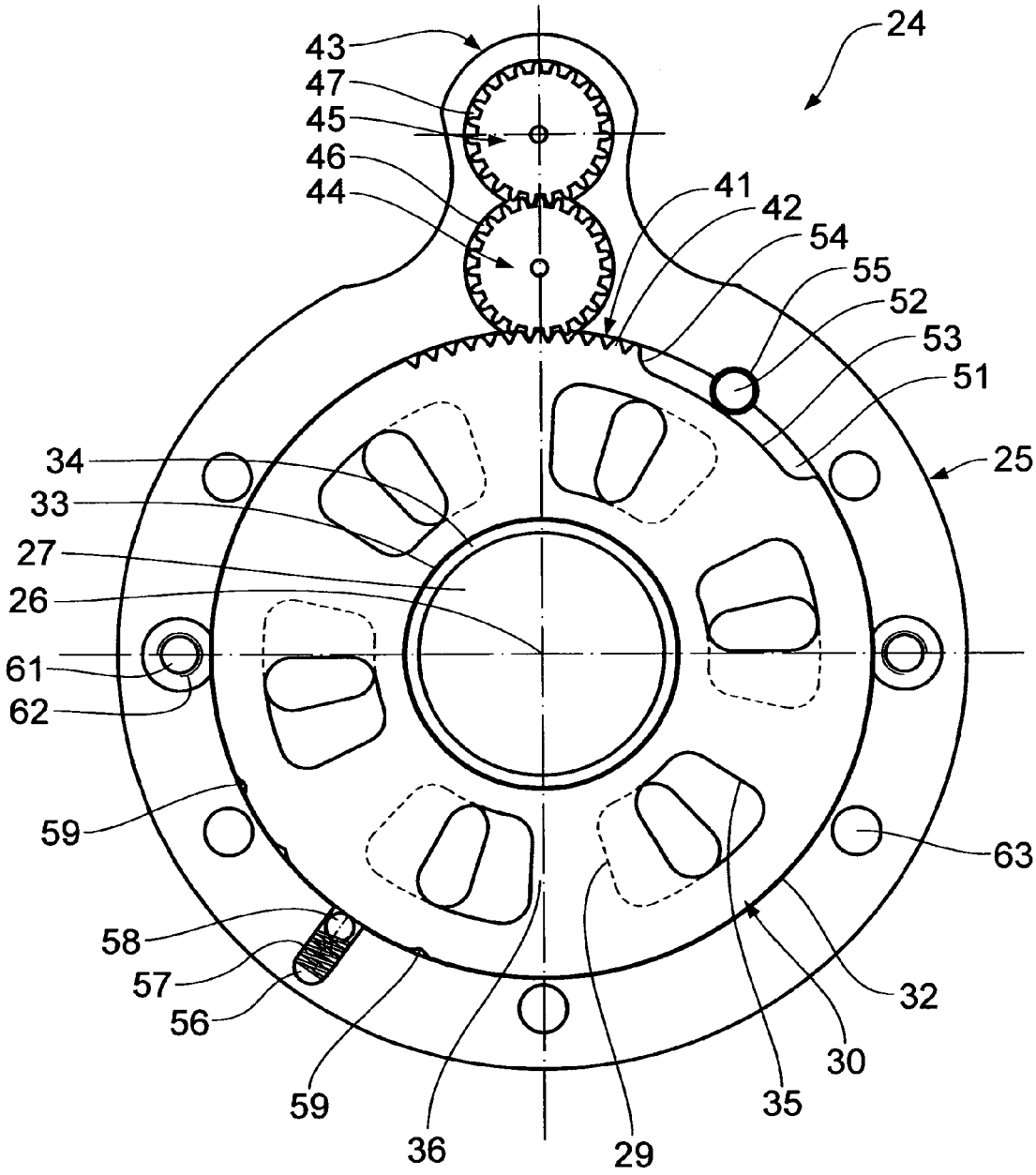
FIG. 2 shows a top view of a muffler outlet part according to a first example embodiment of the invention in a partly open condition.

When the muffler outlet part 24 takes the swivel position shown in FIG. 2, some of the exhaust gas flows from the expansion chamber 20 through the flow pipe openings 19 into the outlet chamber 18, during which process a renewed expansion of the exhaust gas and associated sound absorption are attained. The exhaust gas that flowed into the outlet chamber 18 now flows in the outflow direction 3 to the outlet chamber opening 22 and enters through it and through the first outlet opening 27 of the muffler outlet part 24 into the surrounding environment. The exhaust gas that did not flow into the outlet chamber 18 flows in the outflow direction 3 to the expansion chamber openings 23. Due to the expansion chamber openings 23 being connected to the second outlet openings 29 of the muffler outlet part 24 and the second outlet openings 29 being closed only partially by the bridges 36 of the closing member 30, the exhaust gas flows from the expansion chamber 20 into the surrounding environment without additional expansion.

Figure 3:
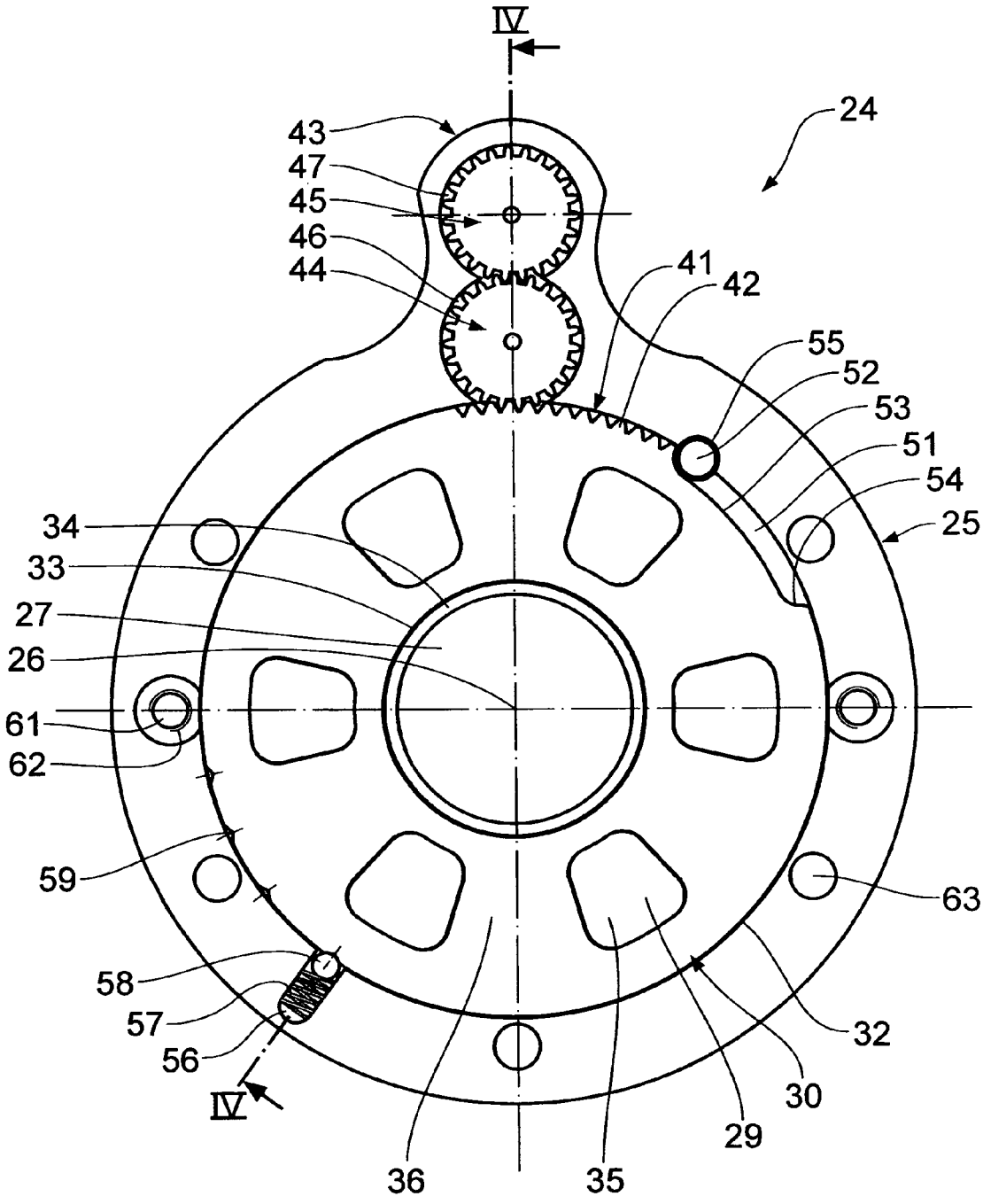
FIG. 3 shows a top view of the muffler outlet part according to FIG. 2 in the fully open condition.
Figure 4:
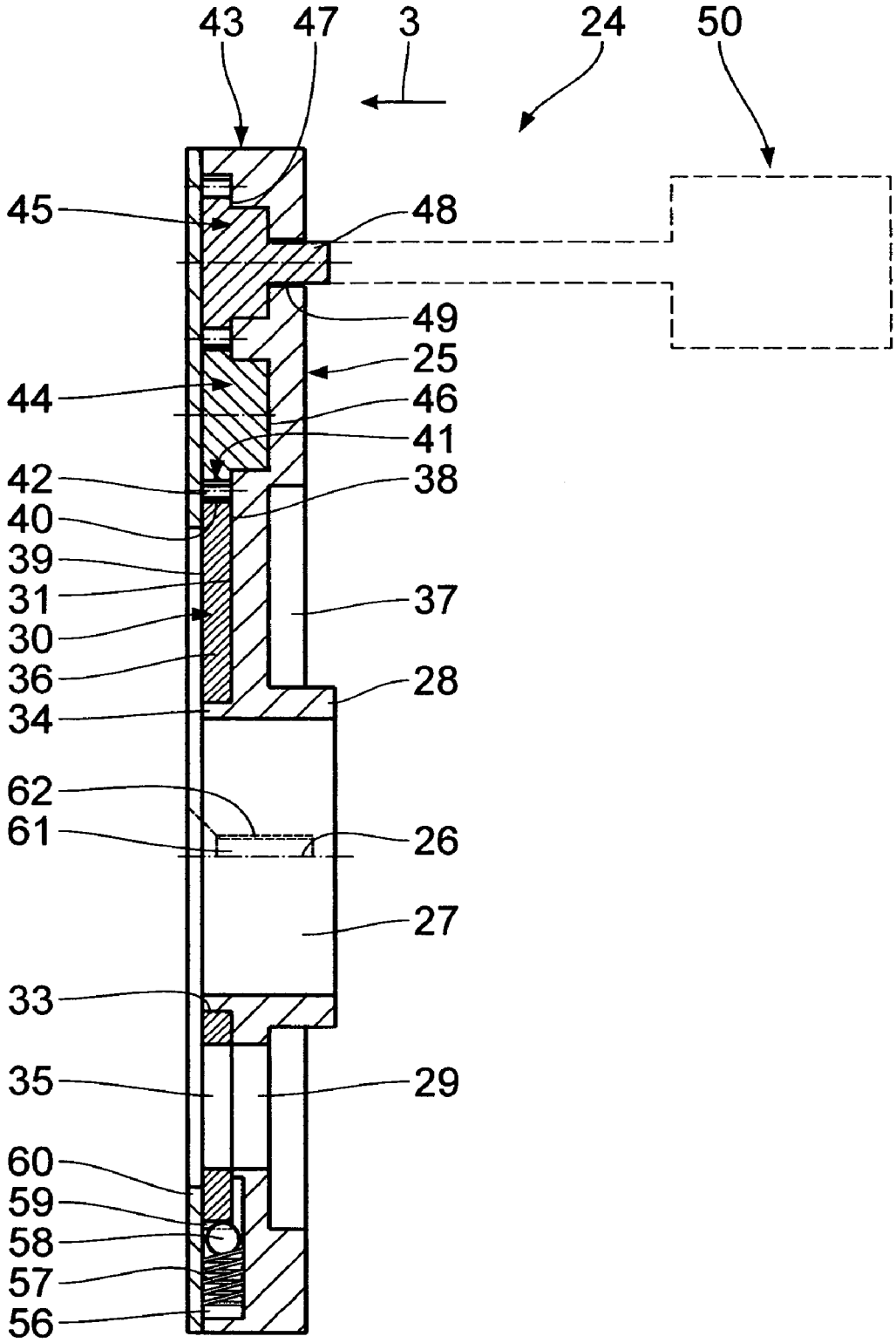
FIG. 4 shows an axial section through the muffler outlet part according to FIG. 3 along the section line IV-IV.

If the closing member 30 is arranged in the first swivel position shown in FIG. 3, the second outlet openings 29 are not closed by the closing-member bridges 36 and are thus maximally open. In the expansion chamber 20, the lower flow resistance of the second outlet openings 29 causes a lower exhaust back pressure to occur, so that the exhaust gas exits substantially unimpeded from the expansion chamber 20 through the expansion chamber openings 23 and through the second outlet openings 29 into the surrounding environment. The portion of the exhaust gas that enters into the outlet chamber 18 and that is subjected to a renewed expansion and sound absorption, therefore, is minimal, so that the muffler 1 attains its maximum sound level in the first swivel position shown in FIG. 3.

If the closing member 30 is arranged in the second swivel position, so that the closing-member bridges 36 completely close the second outlet openings 29, the entire exhaust gas enters from the expansion chamber 20 through the flow pipe openings 19 into the outlet chamber 18 and is thus subjected to a renewed expansion and sound absorption. The muffler 1 thus attains its minimum sound level in the second swivel position. In a swivel position between the first and second swivel position as shown, for example, in FIG. 2, the muffler 1 has a sound level between the minimum and maximum sound level.

To provide for swiveling of the closing member 30 from the swivel position shown in FIG. 2 into the swivel position shown in FIG. 3, a torque is initially applied to the shaft 48 by means of the adjustment means 50. The torque is transmitted via the third adjustment element 45 to the second adjustment element 44 and to the first adjustment element 41. By transmitting the torque to the first adjustment element 41, the closing member 30 in FIG. 2 is swiveled in a clockwise direction. The transmitted torque must be at least great enough for the locking element 58 to be pushed out of the funnel-shaped locking recess 59 against the spring resistance of the spring element 57. During the swiveling of the closing member 30, it is guided by the main-body end stop 32 and bearing ring 34, in such a way that the locking element 58 rolls off on the circumferential wall 40. The swivel movement of the closing member 30 continues until the delimiting element 52 comes in contact against the groove side wall 54, at which time the locking element 58 simultaneously snaps into the locking recess 59 corresponding to the swivel position shown in FIG. 3. The closing member 30 has now reached the swivel position shown in FIG. 3. Any further swiveling in the clockwise direction is now no longer possible. The second outlet openings 29 and the second closing-member openings 35 now lie above each other, so that the second outlet openings 29 are maximally open. A swiveling of the closing member 30 in a counter-clockwise direction takes place in a corresponding manner.

The muffler outlet part 24 permits a simple and convenient adjustment of the sound level of the exhaust system of a motorcycle. By means of the adjustment elements 41, 44, 45, torque is transmitted in a simple manner to the adjusting member 30, so that adjusting the sound level is possible very conveniently, either mechanically, pneumatically, or electrically, by means of the adjustment means 50. With an appropriately designed adjustment means 50, the sound level of the exhaust system even becomes adjustable while riding. The adjustment of the sound level takes place either stepwise, as predefined by the spacing of the locking recesses 59, or it is continuous, without locking recesses 59.

Figure 5:
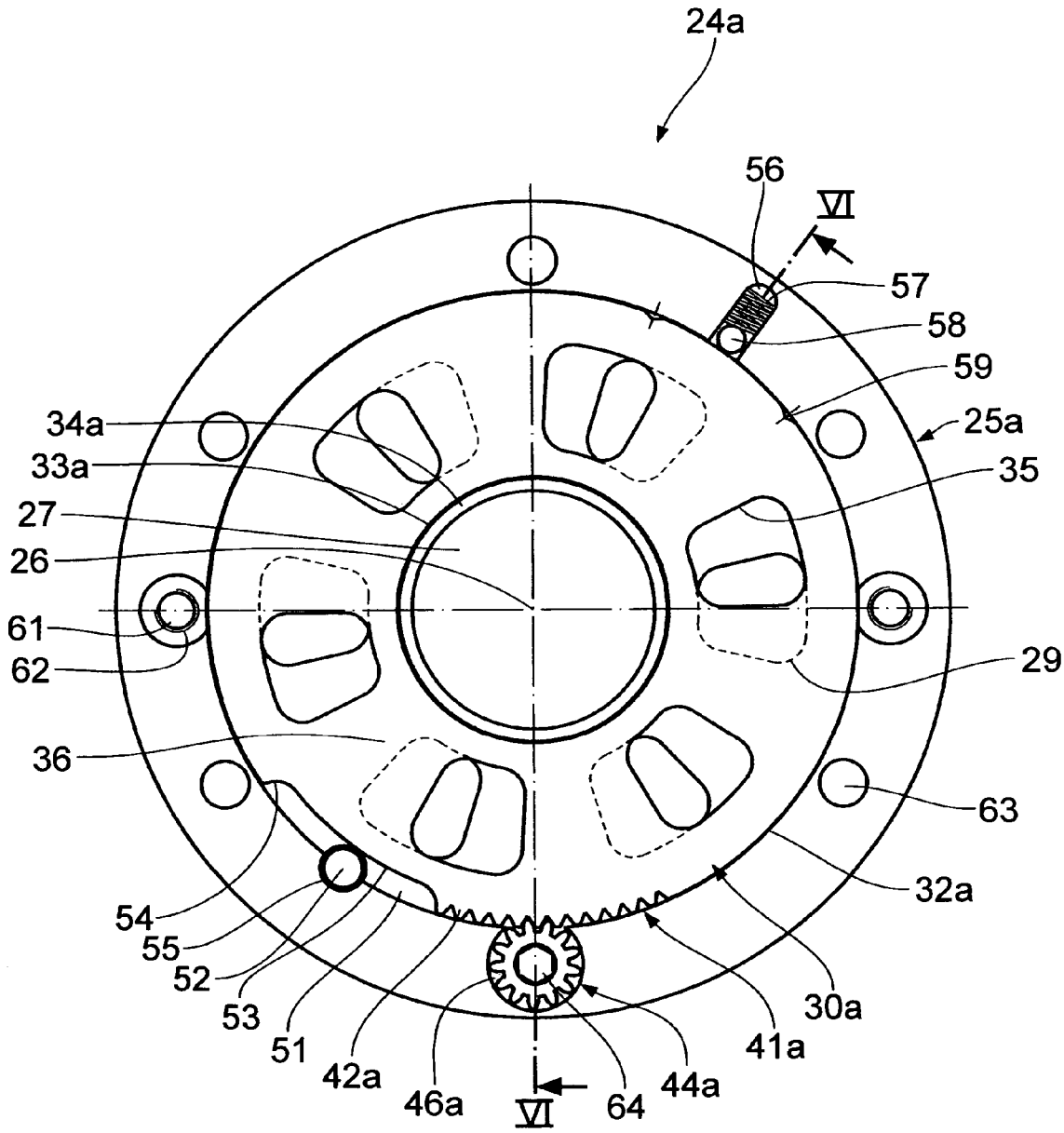
FIG. 5 shows a top view of a muffler outlet part according to a second example embodiment of the invention in a partly open condition.
Figure 6:
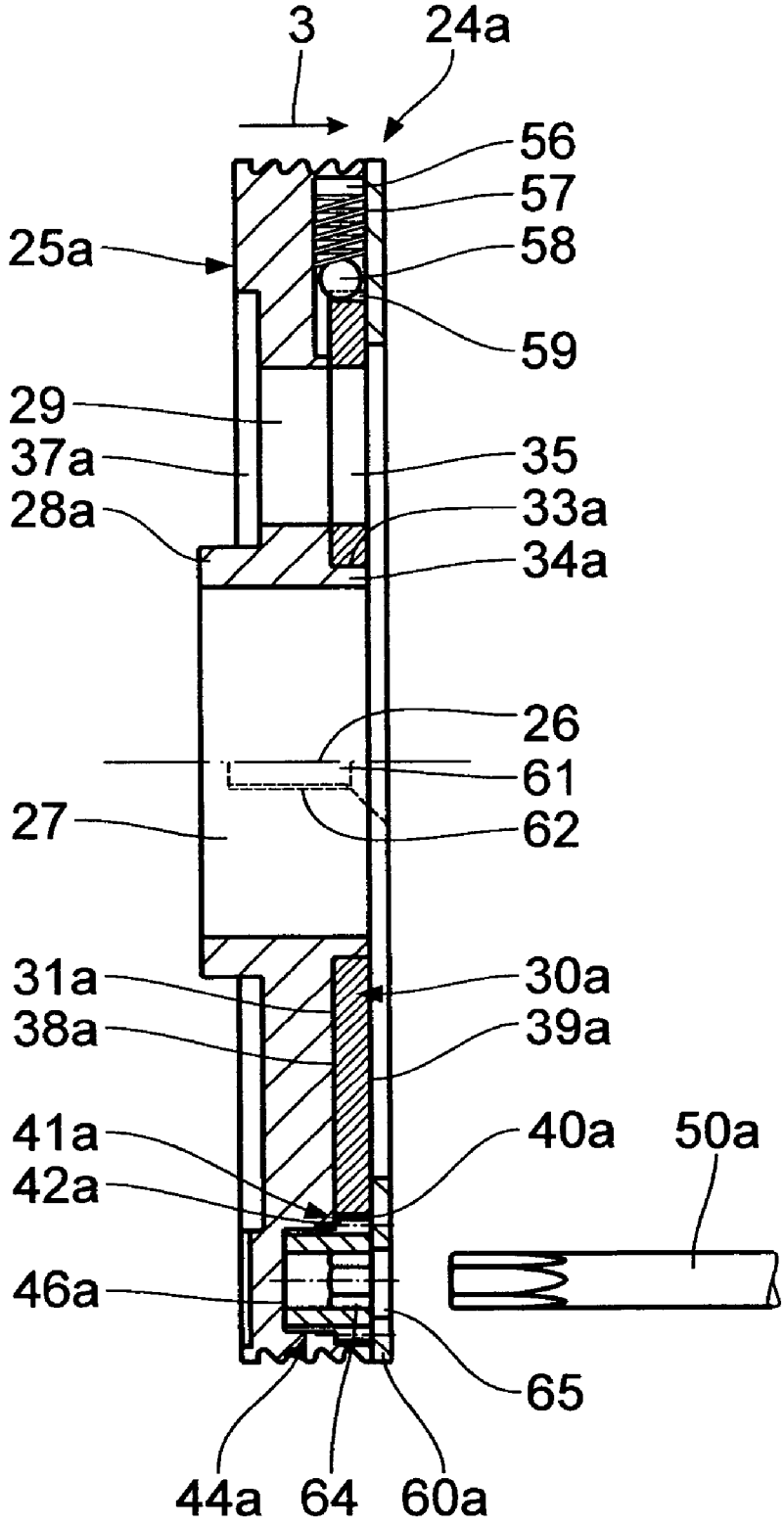
FIG. 6 shows an axial section through the muffler outlet part according to FIG. 5 along the section line VI-VI.

In the text that follows, a second example embodiment of the invention will be described under reference to FIGS. 5 and 6. Parts that have an identical design will be given the same reference numerals as in the first example embodiment, and reference is hereby made to that description. Parts that have a different design but that have the same function will be given the same reference numerals with an "a" placed after the reference numeral. The significant difference compared to the first example embodiment lies in that the second adjustment element **44*a* is designed as a toothed wheel with a polygonal inside recess 64. A third adjustment element is not provided in the case of the muffler outlet part 24*a*. For insertion of the adjustment means 50*a* in the form of a polygonal tool, the closing cap 60*a* has a closing-cap opening 65 disposed concentrically relative to the polygonal inside recess 64. To provide for swiveling of the closing cap 30*a*, the adjustment means 50*a* is inserted through the closing-cap opening 65 into the polygonal inside recess 64. By rotating the adjustment means 50*a*, a torque is transmitted via the polygonal inside recess 64 to the second adjustment means 44***a*. Regarding the further mode of operation, reference is made to the first example embodiment.

Figure 7:
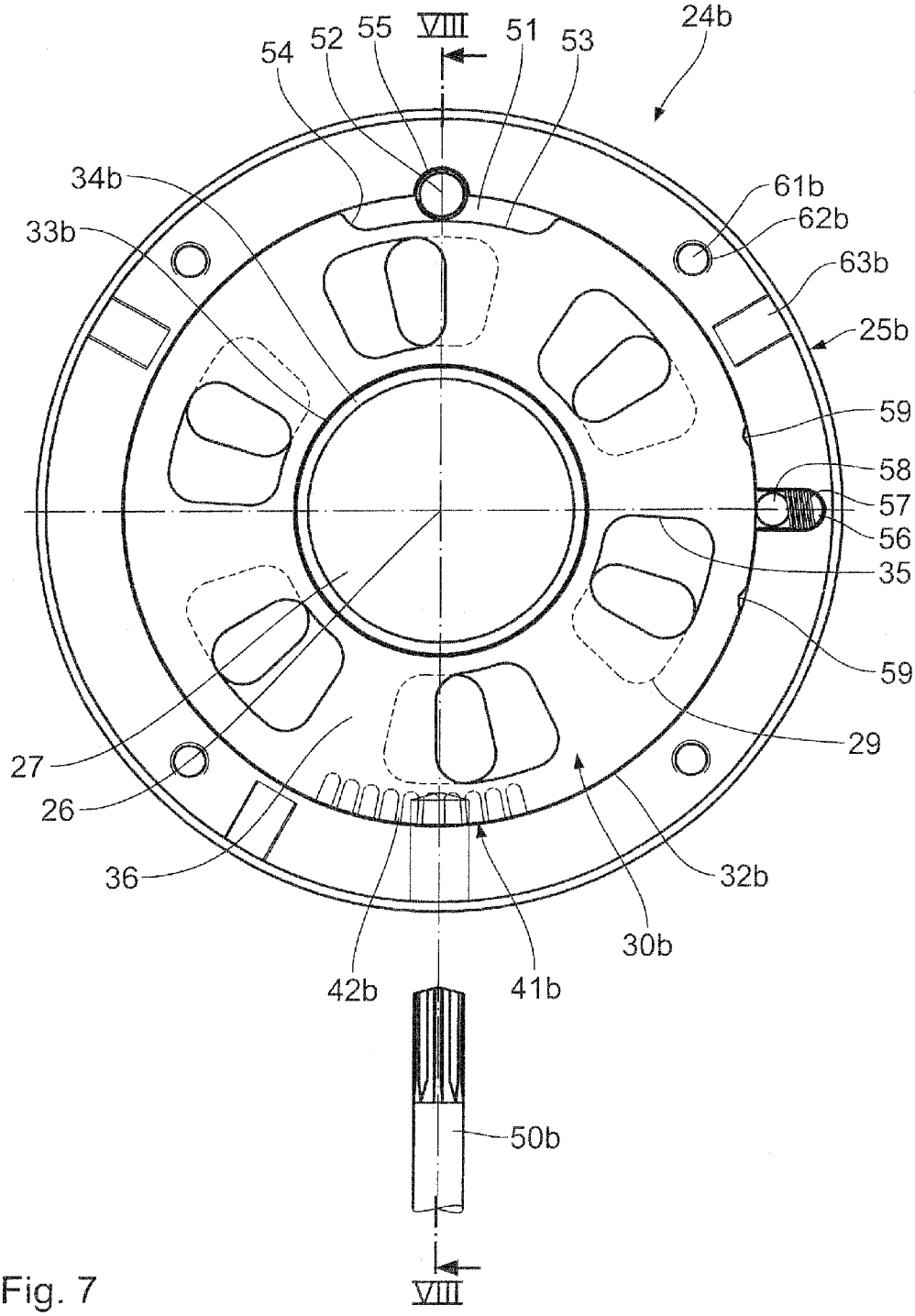
FIG. 7 shows a top view of a muffler outlet part according to a third example embodiment of the invention in a partly open condition.
Figure 8:
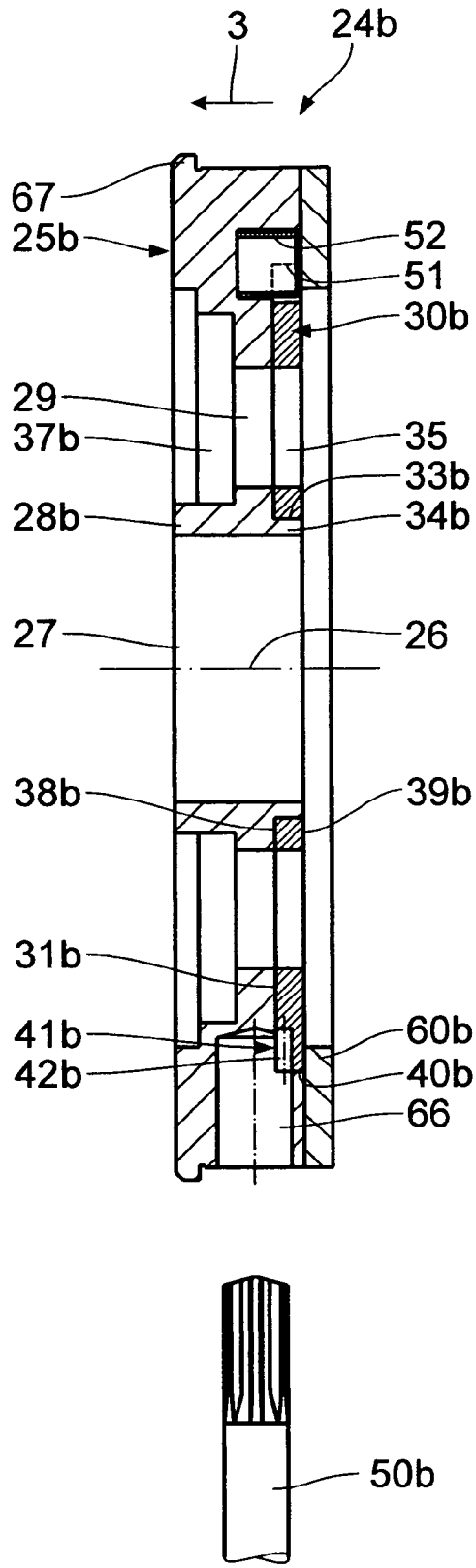
FIG. 8 shows an axial section through the muffler outlet part according to FIG. 7 along the section line VIII-VIII.

In the text that follows, a third example embodiment of the invention will be described under reference to FIGS. 7 and 8. Parts that have an identical design will be given the same reference numerals as in the first example embodiment, and reference is hereby made to that description. Parts that have a different design but that have the same function will be given the same reference numerals with a "b" placed after the reference numeral. The significant difference compared to the previous example embodiments lies in that the teeth 42*b* of the first adjustment element 41*b* are disposed on the first side wall 38*b* of the closing member 30*b*. To provide for actuating the closing member 30*b*, the main body 25*b* has, in the region of the first adjustment element 41*b*, a main-body bore 66 extending transversely to the center axis 26 and up to the teeth 42*b*. Additionally, the muffler outlet part 24*b* is designed to be placed onto the muffler housing 2. To this extent the main body 25*b* has opposite the cover cap 60*b* a radially projecting end-stop ring 67 for the muffler housing 2. The bores 63*b* additionally extend in a radial direction. The connecting ring 28*b*, in this example embodiment, faces an end cover that is not shown. To provide for swiveling of the closing member 30*b*, the adjustment means 50*b* that is designed as a toothed-wheel tool is inserted into the main-body bore 66 until the adjustment means 50*b* engages into the teeth 42*b* of the first adjustment element 41*b*. By rotating the adjustment means 50*b*, a torque is transmitted to the closing member 30*b*. With respect to the further mode of operation, reference is made to the previous example embodiments.

Figure 9:
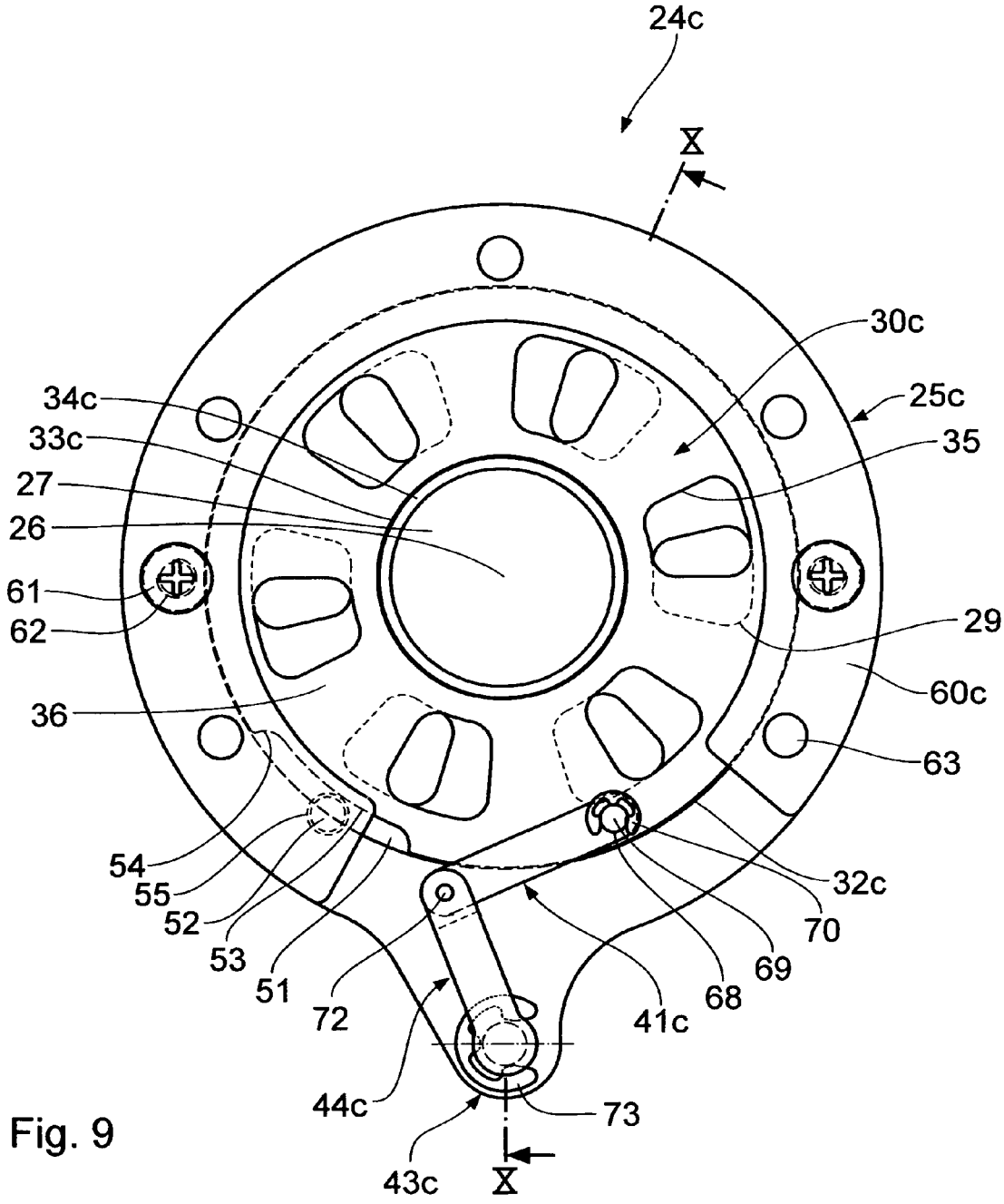
FIG. 9 shows a top view of a muffler outlet part according to a fourth example embodiment of the invention in a partly open condition.
Figure 10:
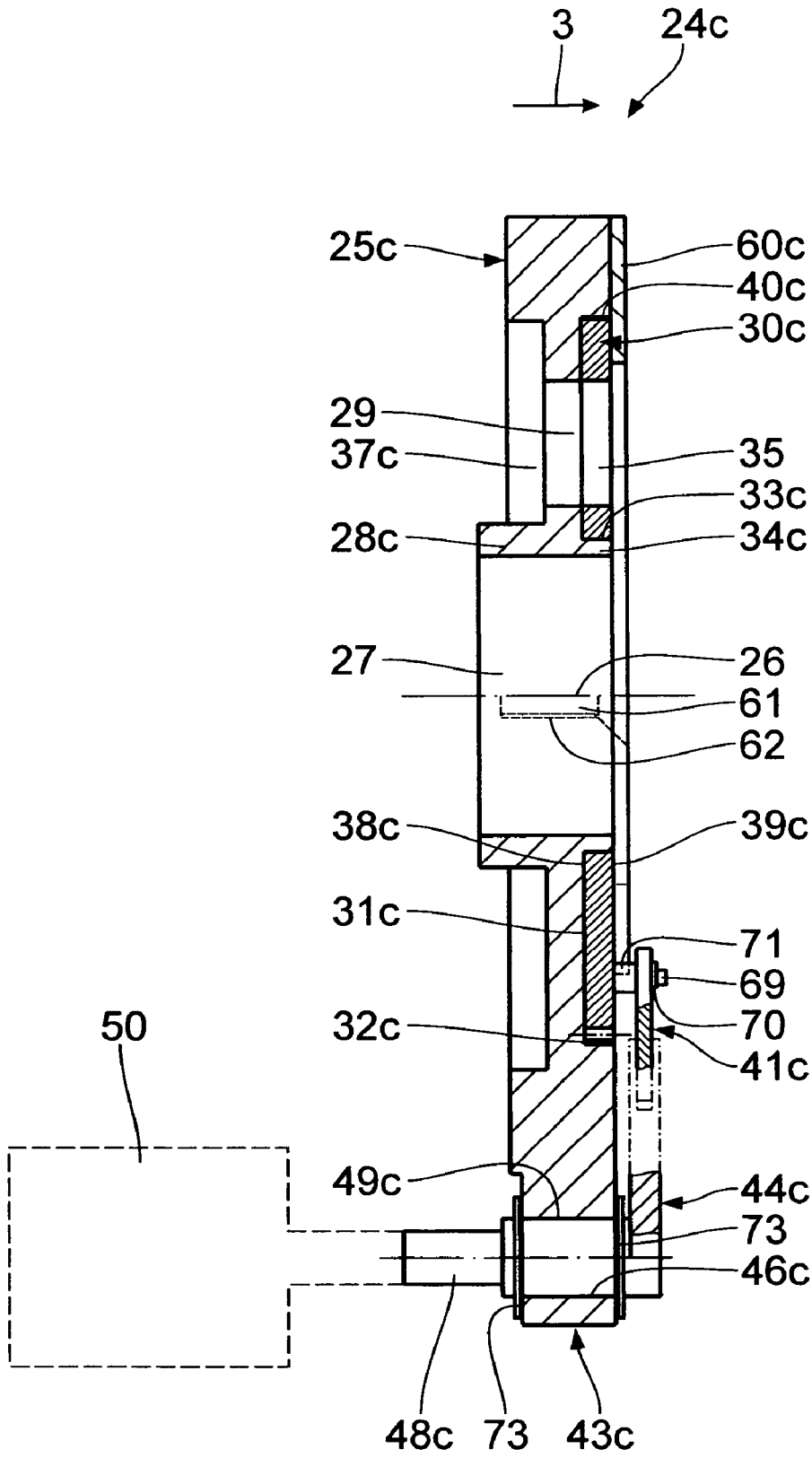
FIG. 10 shows an axial section through the muffler outlet part according to FIG. 9 along the section line X-X.

In the text that follows, a fourth example embodiment of the invention will be described under reference to FIGS. 9 and 10. Parts that have an identical design will be given the same reference numerals as in the first example embodiment, and reference is hereby made to that description. Parts that have a different design but that have the same function will be given the same reference numerals with a "c" placed after the reference numeral. The significant difference compared to the previous example embodiments lies in that the first adjustment element 41*c* and the second adjustment element 44*c* are designed as swivel levers, in such a way that the first adjustment element 41*c* is disposed swivel-mounted on the main member 25*c* and the second adjustment element 44*c* is disposed swivel-mounted on the closing member 30*c*. A third adjustment element is not provided. The first adjustment element 41*c* is disposed with an adjustment-element bore 68 on a bearing journal 69 that is fixed on the closing member 30*c*, and secured by means of a securing ring 70, in such a way that between the closing member 30*c* and the first adjustment element 41*c* a spacer sleeve 71 is provided. To form a swivel hinge 72, the first adjustment element 41*c* is connected swivel-mounted to the second adjustment element 44*c*. The second adjustment element 44*c* is bent at an angle at the end facing away from the first adjustment element 41*c* and guided through the bearing recess 46*c*, as well as secured with securing rings 73 on both sides against any displacement along the center axis 26. The shaft 48*c* is formed as one piece with the second adjustment element 44*c*, in such a way that to transmit a torque according to the first example embodiment, various adjustment means 50 may be used. Additionally, the muffler outlet part 24*c* may be provided with a locking element 58 and locking recesses 59, as described already in the previous example embodiments. To swivel the closing member 30*c*, a torque is exerted with the adjustment means 50 onto the shaft 48*c*, in such a way that the torque is transmitted via the second adjustment element 44*c* and first adjustment element 41*c* to the closing member 30*c*. With respect to the further mode of operation, reference is made to the previous example embodiments.

What is claimed is:

1. A muffler outlet part for a muffler to be used in exhaust systems of motorcycles, having a. at least one main body (25; 25*a*; 25*b*; 25*c*) disposed transversely to an outflow direction (3) of exhaust gas and having a center axis (26), the main body (25; 25*a*; 25*b*; 25*c*) having i. a centrical first outlet opening (27) disposed concentrically relative to the center axis (26) for the outflow of exhaust gas from an outlet chamber (18) of the muffler (1), and ii. at least one second outlet opening (29) disposed eccentrically relative to the center axis (26) for the outflow of exhaust gas from an expansion chamber (20) of the muffler (1), said expansion chamber (20) enclosing the outlet chamber (18), b. at least one closing member (30; 30*a*; 30*b*; 30*c*) that is swivel-mounted about the center axis (26) for an at least partial closing of the at least one second outlet opening (29), wherein the closing member (30; 30*a*; 30*b*; 30*c*), to provide for a locking relative to the main body (25; 25*a*; 25*b*; 25*c*), has locking recesses (59) and an elastic locking element (58), said locking element (58) cooperating with said recesses (59) and being in the form of a ball and being disposed on a spring element (57), for snapping into one of the locking recesses (59) during the locking, and c. at least one adjustment element (41, 44, 45; 41*a*, 44*a*; 41*b*; 41*c*, 44*c*) for swiveling of the closing member (30; 30*a*; 30*b*; 30*c*) via an adjustment means (50; 50*a*; 50*b*), which cooperates in a torque-transmitting manner with the at least one adjustment element (41, 44, 45; 41*a*; 44*a*; 41*b*; 41*c*; 44*c*).

2. A muffler outlet part according to claim 1, wherein the main body (25; 25*a*; 25*b*; 25*c*) for receiving the closing member (30; 30*a*; 30*b*; 30*c*) has a main-body recess (31; 31*a*; 31*b*; 31*c*) disposed concentrically relative to the center axis (26) and forming a main-body end stop (32; 32*a*; 32*b*; 32*c*).

3. A muffler outlet part according to claim 2, wherein the main-body (25; 25*a*; 25*b*; 25*c*) has a main-body end stop recess (56), said spring element (57) being disposed in the main-body end stop recess (56).

4. A muffler outlet part according to claim 3, wherein the main body (25; 25*a*; 25*b*; 25*c*) has a bearing ring (34; 34*a*; 34*b*; 34*c*) enclosing the first outlet opening (27), and the closing member (30; 30*a*; 30*b*; 30*c*) has a centrical first closing-member opening (33), said bearing ring (34; 34*a*; 34*b*; 34*c*) extending at least partially into said first closing-member opening (33).

5. A muffler outlet part according to claim 1, wherein the main body 25; 25*a*; 25*b*; 25*c*) has a bearing ring (34; 34*a*; 34*b*; 34*c*) enclosing the first outlet opening (27), and the closing member 30; 30*a*; 30*b*; 30*c*) has a centrical first closing-member opening (33), said bearing ring (34; 34*a*; 34*b*; 34*c*) extending at least partially into said first closing-member opening (33).

6. A muffler outlet part according to claim 1, wherein the closing member 30; 30*a*; 30*b*; 30*c*) is designed ring-shaped and has at least one second closing-member opening (35) corresponding to the at least one second outlet opening (29).

7. A muffler outlet part according to claim 1, wherein the at least one adjustment element (41; 41*a*; 41*b*) is designed as a toothing having a plurality of successive teeth (42; 42*a*; 42*b*)

for transmitting a torque in order to swivel the closing member (30; 30*a*; 30*b*) around the center axis (26).

8. A muffler outlet part according to claim 7, wherein the teeth (42; 42*a*) are disposed along a circumferential wall (40; 40*a*) of the closing member (30; 30*a*).

9. A muffler outlet part according to claim 7, wherein to provide for the cooperation with the teeth (42; 42*a*) at least one additional adjustment element (44, 45; 44*a*) is provided that is designed as a toothed wheel.

10. A muffler outlet part according to claim 7, wherein the teeth (42*b*) are disposed on one side wall (38*b*) of the closing member (30*b*).

11. A muffler outlet part according to claim 1, wherein the at least one adjustment element (41*c*; 44*c*) is designed as a swivel lever, in such a way that at least one first swivel lever is disposed swivel-mounted on the main body (25*c*), and a second swivel lever is disposed swivel-mounted on the closing member (30*c*) for transmitting a torque in order to swivel the closing member (30*c*) around the center axis (26).

12. A muffler outlet part according to claim 1, wherein the closing member (30; 30*a*; 30*b*; 30*c*) for delimiting the swivel movement has at least one groove (51) extending concentrically relative to the center axis (26) and cooperating with at least one delimiting element (52).

13. A muffler to be used in exhaust systems of motorcycles, comprising a. an intake chamber (17) connected to an inlet opening (21) for the inflow of exhaust gas, b. an outlet chamber (18) disposed downstream from the intake chamber (17) in an outflow direction (3) of exhaust gas, c. an expansion chamber (20) connected to the intake chamber (17) and to the outlet chamber (18) and at least partially enclosing them, and d. the muffler outlet part (24; 24*a*; 24*b*; 24*c*) according to claim 1, said muffler outlet part being disposed downstream from the outlet chamber (18) in the outflow direction (3) wherein i. the outlet chamber (18) is connected to a first outlet opening (27) for the outflow of exhaust gas, and ii. the expansion chamber (20) is connected to at least one, at least partially closeable second outlet opening (29) for adjusting the sound level of the muffler (1).

14. A muffler according to claim 13, wherein the inlet opening (21) is enclosed by a flow pipe (13), and wherein a gastight baffle plate (16) divides the flow pipe (13) into the intake chamber (17) and the outlet chamber (18).

15. A muffler according to claim 14, wherein the intake chamber (17) and the outlet chamber (18) are connected by a plurality of flow pipe openings (19) to the expansion chamber (20), said flow pipe openings (19) being disposed in the flow pipe (13) in a region of the baffle plate (16).

16. A muffler outlet part for a muffler to be used in exhaust systems of motorcycles, having a. at least one main body (25; 25*a*; 25*b*) disposed transversely to an outflow direction (3) of exhaust gas and having a center axis (26), the main body (25; 25*a*; 25*b*) having i. a centrical first outlet opening (27) disposed concentrically relative to the center axis (26) for the outflow of exhaust gas from an outlet chamber (18) of the muffler (1), and ii. at least one second outlet opening (29) disposed eccentrically relative to the center axis (26) for the outflow of exhaust gas from an expansion chamber (20) of the muffler (1), said expansion chamber (20) enclosing the outlet chamber (18), b. at least one closing member (30; 30*a*; 30*b*) that is swivel-mounted about the center axis (26) for an at least partial closing of the at least one second outlet opening (29), and c. at least one adjustment element (41, 44, 45; 41*a*; 44*a*; 41*b*) for swiveling of the closing member (30; 30*a*; 30*b*) via an adjustment means (50; 50*a*; 50*b*), which cooperates in a torque-transmitting manner with the at least one adjustment element (41, 44, 45; 41*a*; 44*a*; 41*b*), wherein the at least one adjustment element (41; 41*a*; 41*b*) is designed as a toothing having a plurality of successive teeth (42; 42*a*; 42*b*) for transmitting a torque in order to swivel the closing member (30; 30*a*; 30*b*) around the center axis (26).

17. A muffler outlet part according to claim 16, wherein the main body (25; 25*a*) for receiving the closing member (30; 30*a*) has a main-body recess (31; 31*a*) disposed concentrically relative to the center axis (26) and forming a main-body end stop (32; 32*a*) and wherein the teeth (42; 42*a*) are disposed along a circumferential wall (40; 40*a*) facing the main-body end stop (32; 32*a*).

18. A muffler outlet part according to claim 17, wherein to provide for the cooperation with the teeth (42; 42*a*) at least one additional adjustment element (44; 45; 44*a*) is provided that is designed as a toothed wheel, and wherein the main body (25; 25*a*) has a bearing recess (46; 46*a*) in which the toothed wheel is accommodated in a manner so that it can rotate.

19. A muffler outlet part according to claim 16, wherein the teeth (42*b*) are disposed on a side wall (38*b*) of the closing member (30*b*) facing the main body (25*b*).

20. A muffer outlet part according to claim 19, wherein the main body (25*b*) has a main-body bore (66) extending transversely to the center axis (26) and up to the teeth (42*b*).

21. A muffler outlet part according to claim 16, wherein the number of teeth (42; 42*a*; 42*b*) of the at least one adjustment element (41; 41*a*; 41*b*) is such that the closing member (30; 30*a*; 30*b*) can swivel at least from a first swivel position in which the at least one second outlet opening (29) is completely opened into a second swivel position in which the at least one second outlet opening (29) is completely closed.

22. A muffler to be used in exhaust systems of motorcycles, comprising a. an intake chamber (17) connected to an inlet opening (21) for the inflow of exhaust gas, b. an outlet chamber (18) disposed downstream from the intake chamber (17) in an outflow direction (3) of exhaust gas, c. an expansion chamber (20) connected to the intake chamber (17) and to the outlet chamber (18) and at least partially enclosing them, and d. the muffler outlet part (24; 24*a*; 24*b*) according to claim 16, said muffler outlet part being disposed downstream from the outlet chamber (18) in the outflow direction (3), wherein i. the outlet chamber (18) is connected to a first outlet opening (27) for the outflow of exhaust gas, and ii. the expansion chamber (20) is connected to at least one, at least partially closeable second outlet opening (29) for adjusting the sound level of the muffler (1).

23. A muffler according to claim 22, wherein the inlet opening (21) is enclosed by a flow pipe (13), and wherein a gastight baffle plate (16) divides the flow pipe (13) into the intake chamber (17) and the outlet chamber (18).

24. A muffler according to claim 23, wherein the intake chamber (17) and the outlet chamber (18) are connected by a plurality of flow pipe openings (19) to the expansion chamber (20), said flow pipe openings (19) being disposed in the flow pipe (13) in a region of the baffle plate (16).

25. A muffler outlet part for a muffler to be used in exhaust systems of motorcycles, having a. at least one main body (25*c*) disposed transversely to an outflow direction (3) of exhaust gas and having a center axis (26), the main body (25*c*) having i. a centrical first outlet opening (27) disposed concentrically relative to the center axis (26) for the outflow of exhaust gas from an outlet chamber (18) of the muffler (1), and ii. at least one second outlet opening (29) disposed eccentrically relative to the center axis (26) for the outflow of exhaust gas from an expansion chamber (20) of the muffler (1), said expansion chamber (20) enclosing the outlet chamber (18), b. at least one closing member (30*c*) that is swivel-mounted about the center axis (26) for an at least partial closing of the at least one second outlet opening (29), c. at least one adjustment element (41*c*; 44*c*) wherein a first adjustment element (41*c*) and a second adjustment element (44*c*) are designed as swivel levers, in such a way that the first adjustment element (41*c*) is disposed swivel-mounted on the closing member (30*c*) and the second adjustment element (44*c*) is disposed swivel-mounted on the main body (25*c*) for transmitting a torque in order to swivel the closing member (30*c*) around the center axis (26), and d. an adjustment means (50), which cooperates in a torque-transmitting manner with the at least one adjustment element (41*c*; 44*c*).

26. A muffler outlet part according to claim 25, wherein the second adjustment element (44*c*) is bent at an angle at an end facing away from the first adjustment element (41*c*) and is guided through a bearing recess (46*c*) of the main body (25*c*).

27. A muffler outlet part according to claim 25, wherein a shaft (48*c*) is formed as one piece with the second adjustment element (44*c*), and wherein the adjustment means (50) is an electrical motor which is connected in a torque-transmitting manner with the shaft (48*c*).

28. A muffler to be used in exhaust systems of motorcycles, comprising a. an intake chamber (17) connected to an inlet opening (21) for the inflow of exhaust gas, b. an outlet chamber (18) disposed downstream from the intake chamber (17) in an outflow direction (3) of exhaust gas, c. an expansion chamber (20) connected to the intake chamber (17) and to the outlet chamber (18) and at least partially enclosing them, and d. the muffler outlet part (24*c*) according to claim 26, said muffle outlet part being disposed downstream from the outlet chamber (18) in the outflow direction (3), wherein i. the outlet chamber (18) is connected to a first outlet opening (27) for the outflow of exhaust gas, and ii. the expansion chamber (20) is connected to at least one, at least partially closeable second outlet opening (29) for adjusting the sound level of the muffler (1).

29. A muffler according to claim 28, wherein the inlet opening (21) is enclosed by a flow pipe (13), and wherein a gastight baffle plate (16) divides the flow pipe (13) into the intake chamber (17) and the outlet chamber (18).

30. A muffler according to claim 29, wherein the intake chamber (17) and the outlet chamber (18) are connected by a plurality of flow pipe openings (19) to the expansion chamber (20), said flow pipe openings (19) being disposed in the flow pipe (13) in a region of the baffle plate (16).

* * * * *